US006241017B1

(12) United States Patent
Doane et al.

(10) Patent No.: US 6,241,017 B1
(45) Date of Patent: Jun. 5, 2001

(54) CAGED SLIP SYSTEM AND RELEASE METHODS

(75) Inventors: James C. Doane, Friendswood; Henry Joe Jordan, Jr., Conroe; Hector H. Mireles, Jr., Spring, all of TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/416,732

(22) Filed: Oct. 13, 1999

Related U.S. Application Data

(60) Provisional application No. 60/104,833, filed on Oct. 19, 1998.

(51) Int. Cl.[7] ..... E21B 23/01

(52) U.S. Cl. ..... 166/134; 166/137; 166/217

(58) Field of Search ..... 166/118, 123, 166/134, 137, 216, 217, 138, 139

(56) References Cited

U.S. PATENT DOCUMENTS

| | | | |
|---|---|---|---|
| 3,291,220 | 12/1966 | Mott . | |
| 4,664,188 | 5/1987 | Zunkel et al. | 166/134 |
| 4,750,559 | 6/1988 | Greenlee et al. . | |
| 4,984,636 | 1/1991 | Bailey et al. | 166/277 |
| 6,119,774 * | 9/2000 | Doane et al. | 166/134 |

* cited by examiner

*Primary Examiner*—William Neuder
(74) *Attorney, Agent, or Firm*—Duane, Morris & Heckscher, LLP

(57) ABSTRACT

An improved cage slip system is disclosed. The cage is constructed so that the cones which actuate the slips extend into the cage openings. The radial extension of the slips is limited so as to retain them if they are extended in an unsupported situation. The cones have a maximum outside dimension equal to the outside dimension of the cage so as to increase the rating of the slips by increasing the bearing area of the cones on the slips. The beneficial features of the cage design are retained while a greater degree of radial expansion of the slips is possible allowing minimization of tool inventory for situations where a lighter wall casing requires further slip extension. The release system allows the lower cones to be driven out from under the lower slips, thus facilitating release of the grip of the lower slips from the casing for extraction of the packer. The mechanical release is functional through the mandrel, whether tension or compression is placed on the mandrel. Alternative designs are presented for the capture of the lower cone by the cage.

37 Claims, 16 Drawing Sheets

CAGED SLIP SYSTEM AND RELEASE METHODS

This application claims benefit to Provisional application Ser. No. 60/104,833 filed Oct. 19, 1998.

FIELD OF THE INVENTION

The field of this invention relates to retention devices for downhole tools, particularly slip systems located in cages and release methods for such systems.

BACKGROUND OF THE INVENTION

Slips are used in downhole tools such as packers to retain the position of the tool. Slips can be provided in a cage where a sleeve has openings through which the slips extend, separated by structural components of the cage to give it the integrity needed to withstand forces applied during the operation of the tool. These conventional caged slip systems offer protection to the slips while running in the hole. Apart from protecting the slips during run-in, the cage itself typically serves as a pickup device when retrieving slips. One of the design drawbacks of existing caged slip systems is a limitation on the extendable diametrical range of the slips. The longitudinal elements which define the openings through which the slips extend also serve as travel stops. Since these longitudinal components require a predetermined structural strength, they cannot be thinned to allow additional slip extension. This concept is illustrated in FIG. 1 which shows the prior art. In FIG. 1 a prospective view of a slip 10 is shown. The cross-section of the slip 10 is U shaped and the longitudinal strip 12 extends within the U and acts as an outward travel stop for the caged slip 10. The openings or windows 14 are defined between the longitudinal strips 12. Accordingly, in the prior art, the requisite thickness of the longitudinal strips 12 limited the amount of outward travel of the slips 10. Additionally, in the prior art designs, the cones which would force the slips outwardly were located inside the cage as represented graphically by arrow 16. One such product is the Model SC-2P retrievable packer made by Baker Oil Tools. The placement of the cones within the cage defined by longitudinal members 12 reduced the available bearing area of the cones on the slips and therefore limited the capacity of the slips to resist differential forces which are present in the wellbore. Thus, these two significant limitations of prior caged slip designs amounted to lower performance ratings of the overall tool, as well as the need to have more tools available for varying sizes of casing. The reason for this was that depending on the casing weight per foot, its inside dimension would vary. Thus, different tools might be needed in the prior art to extend sufficiently far if lighter wall casing was in use.

Thus, some of the objectives of the present invention are to allow greater extension of the slips while retaining or expanding the ability of the slip system to withstand differential loads. Additionally, another objective is to allow within a given tool body size sufficient rangeability and slip extension so as to avoid stocking a large inventory of tools to handle a variety of situations. Another objective is to uniquely position the cone within the openings of the cage so that the cones extend outwardly as far as the outer extremity of the cage. All this is accomplished while at the same time retaining the beneficial qualities of a caged slip during run-in. Another objective, which is accomplished by putting the cones in the windows of the cage, allows the cage thickness to be increased to improve its tensile strength without reduction of the amount of slip extension. Finally, another objective is to be able to retain the slips to a predetermined extension diametrically outwardly. Thus, the slips are limited in radial extension to prevent them from escaping the cage if they are extended in an unsupported condition. Yet another objective of the present invention is to facilitate release of the slips by mechanically driving the lower cone out from the lowermost slips, as opposed to trying to pull and disengage slips off of a stationary cone. The objective of the release system is to be able to unsupport the slips, regardless of whether the mandrel of the packer is in tension or compression so that the slip is not pulled away from a cone when the cone forces the wickers of the slip against a casing or tubular. Those and other features of the present invention will become more apparent to those skilled in the art from a review of the preferred embodiment described below.

SUMMARY OF THE INVENTION

An improved caged slip system is disclosed. The cage is constructed so that the cones which actuate the slips extend into the cage openings. The radial extension of the slips is limited so as to retain them if they are extended in an unsupported situation. The cones have a maximum outside dimension equal to the outside dimension of the cage so as to increase the rating of the slips by increasing the bearing area of the cones on the slips. The beneficial features of the cage design are retained while a greater degree of radial expansion of the slips is possible allowing minimization of tool inventory for situations where a lighter wall casing requires further slip extension. The release system allows the lower cones to be driven out from under the lower slips, thus facilitating release of the grip of the lower slips from the casing for extraction of the packer. The mechanical release is functional through the mandrel, whether tension or compression is placed on the mandrel. Alternative designs are presented for the capture of the lower cone by the cage.

DETAILED DESCRIPTION OF THE PREFERRED EMBODIMENT

Figure 2:
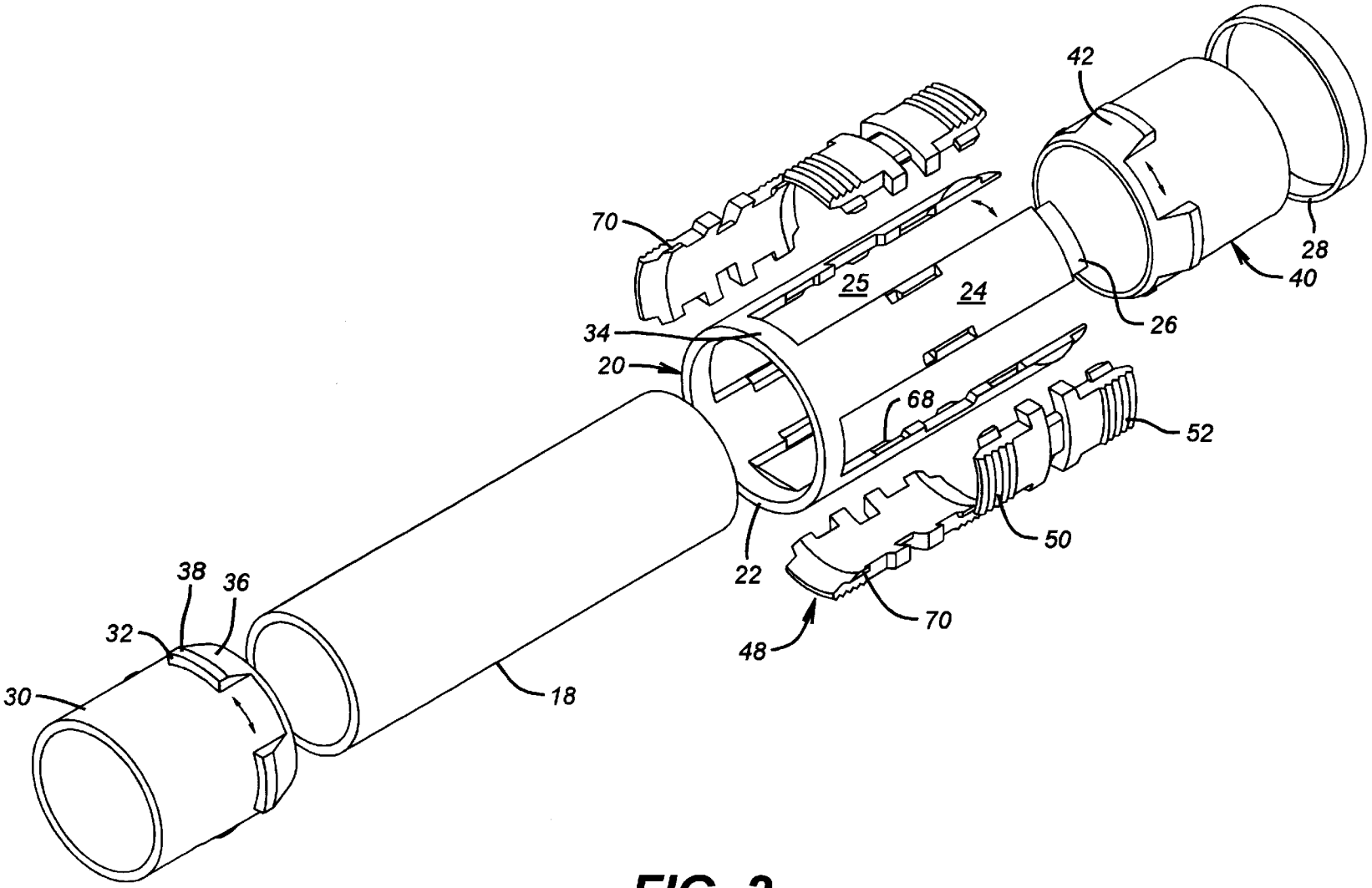
FIG. 2 is a perspective exploded view of the apparatus.
Figure 5A:
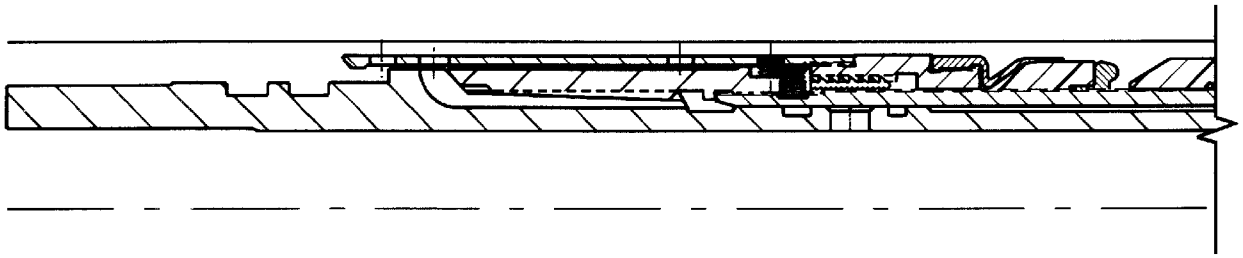
FIGS. 5*a*–5*c* are a sectional view of a packer using the slips of the present invention in the run-in position.
Figure 6A:
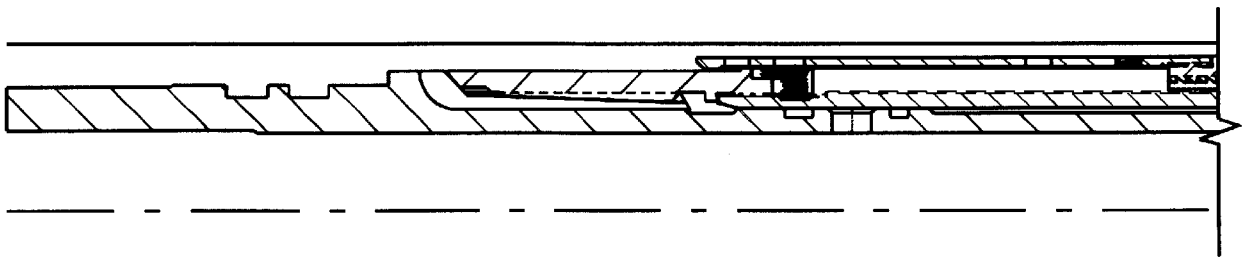
FIGS. 6*a*–6*c* are the same views as shown in FIGS. 5*a–c* with the slips in the set position.
Figure 5B:
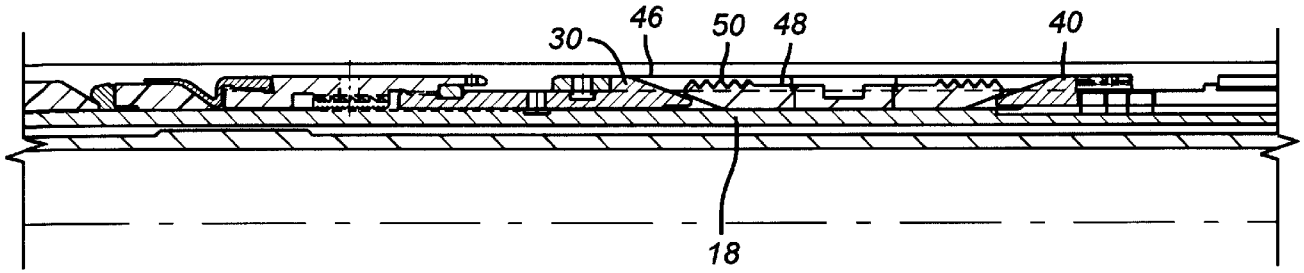
Figure 6B:
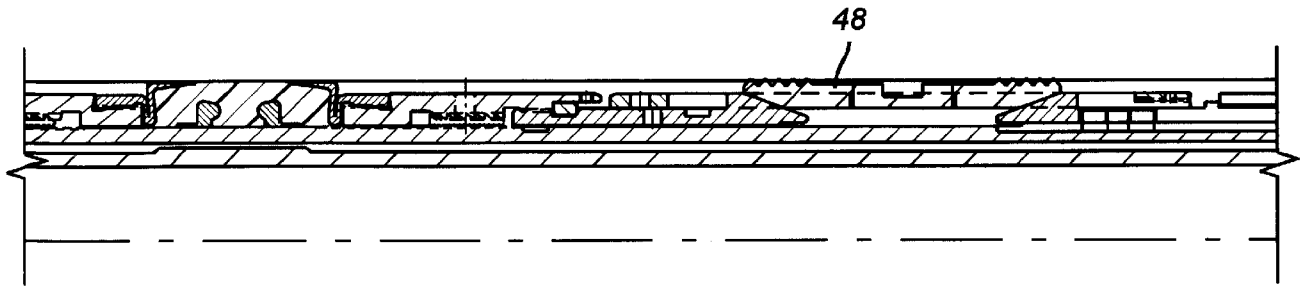
Figure 5C:
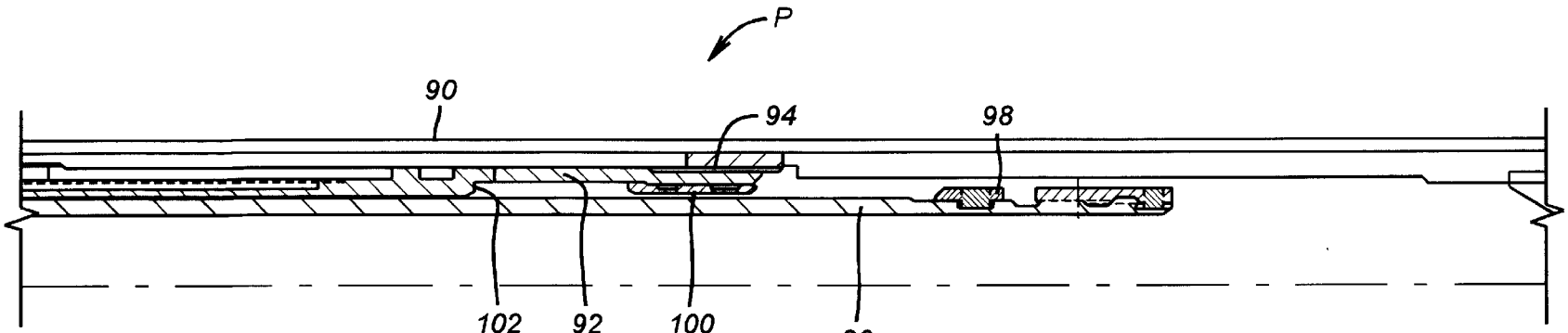
Figure 6C:
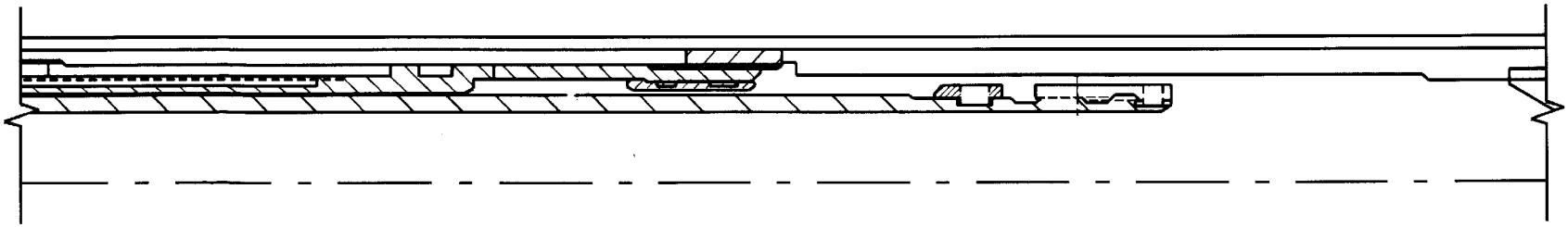
Figure 7A:
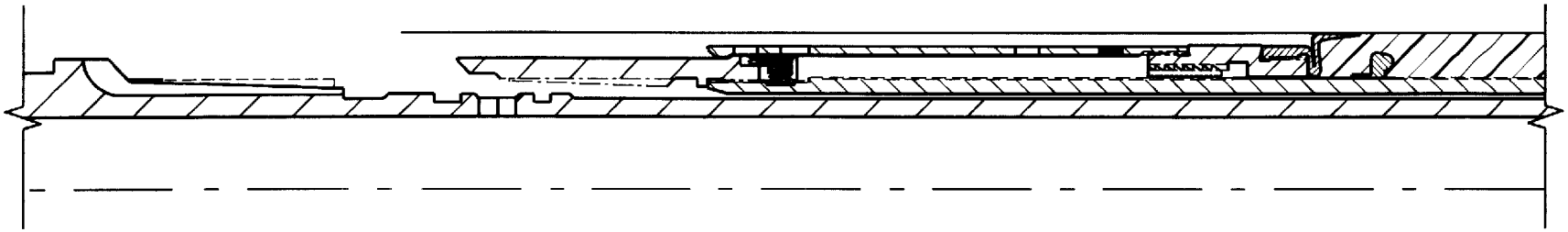
FIGS. 7*a–c* are the same views as FIGS. 6*a–c* with the slips now in the released position.
Figure 8A:
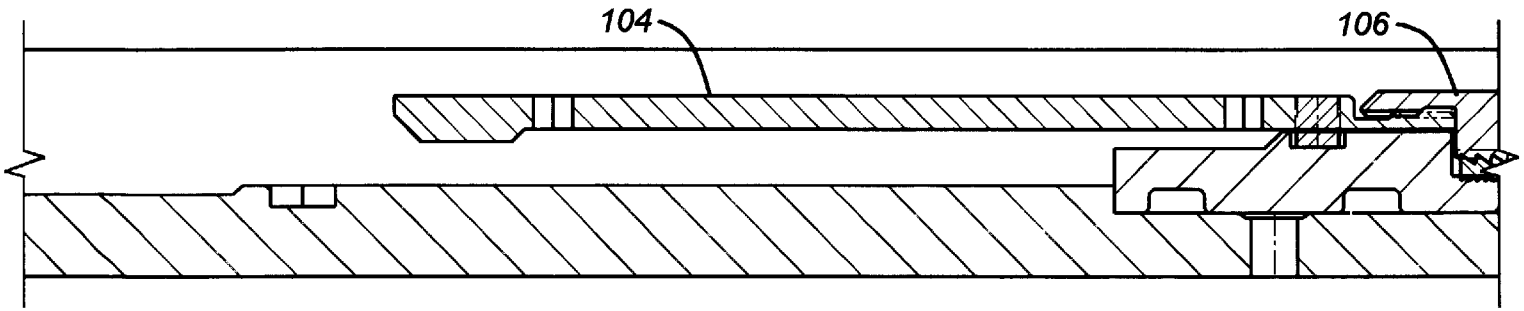
FIGS. 8*a–d* illustrate the preferred embodiment which facilitates mechanical displacement of the lower cone away from the lower slips, illustrating the assembly in the run-in position.
Figure 7B:
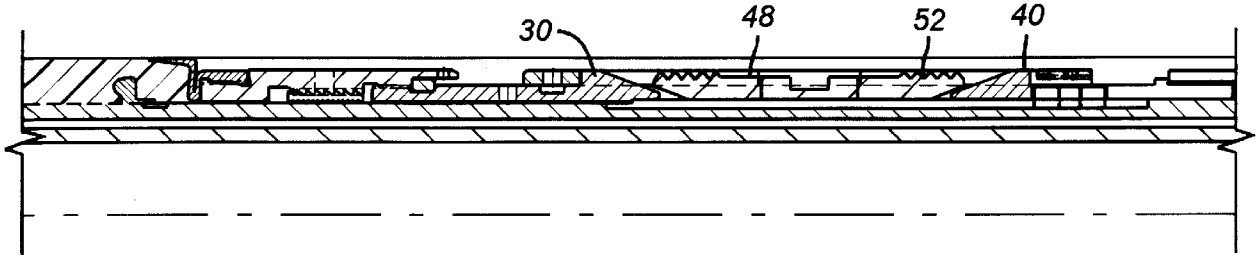
Figure 8B:
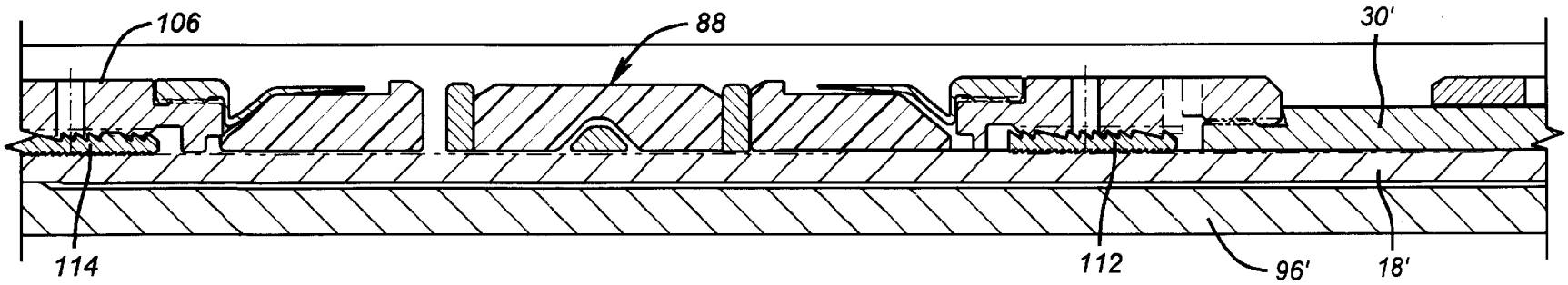
Figure 7C:
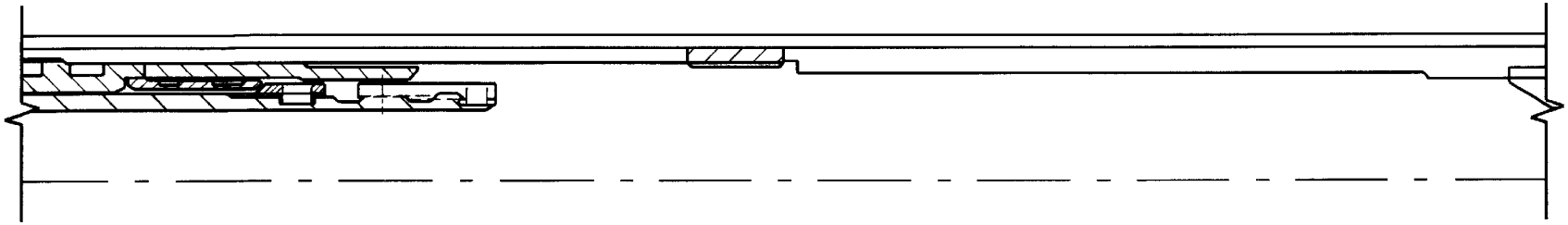

FIG. 2 illustrates the slip area of a downhole tool which in the preferred embodiments shown in FIGS. 5–7 is a packer. FIG. 2 illustrates the Mandrel 18 which can also be seen in FIG. 5*b*. The exploded view of FIG. 2 aids in understanding of how the assembly is put together and further aids in understanding of its operation. The cage 20 has a closed end 22 from which extend a series of longitudinal members 24 defining openings or windows 25. At their lower end 26, each of the longitudinal members 24 are threaded so as to accept a ring 28 in order to complete the assembly. Other mechanisms for attaching the ring 28 to the longitudinal members 24 are within the purview of the invention. To begin the assembly, cone 30 is initially inserted through lower end 26 so that the shoulder 32 is retained by member 34 which forms a part of the closed end 22. As shown in FIG. 2, there are four discrete ramps 36, each having an outer dimension 38 with shoulder 32 defined adjacent thereto. The outer dimension 38 of the cone 30 is, at most, equal to, but can be smaller than, the outer dimension of the members 34 which define the closed end 22 of the cage 20.

Figure 3:
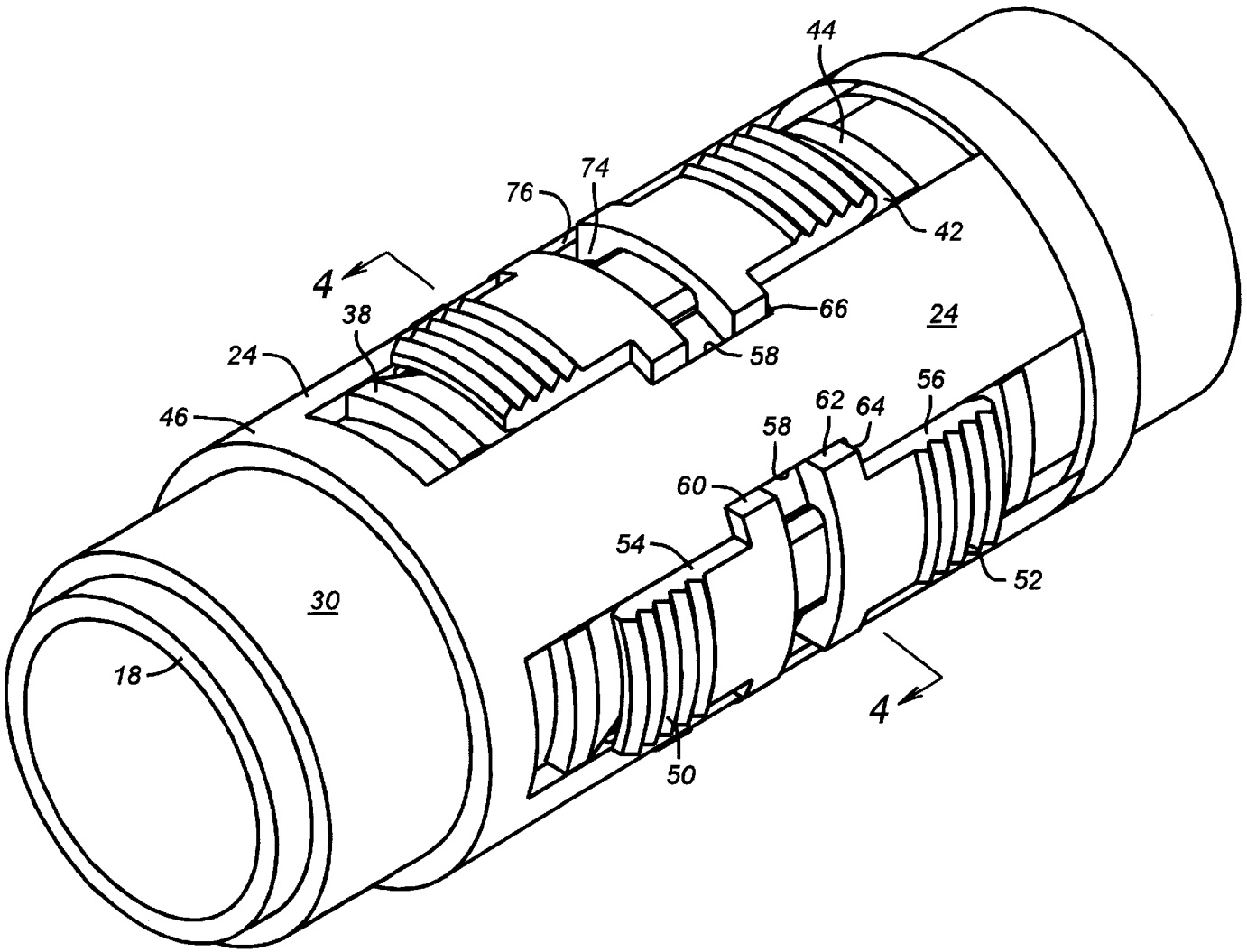
FIG. 3 is an assembled perspective view of the same apparatus.

With cone 30 inserted through the open end of cage 20 until shoulders 32 connect with members 34, the slips 48 are pushed into place and the mandrel 18 can now be installed through cones 30 and 40 which are already in place with respect to cage 20. Cone 40, which is preferably identical to cone 30 but in opposed orientation, slides over the mandrel 18 past lower end 26. Again, the tapers 42 extend in the gap between the longitudinal members 24 as shown in FIG. 3. The outer dimension 44 of the cone 40 is equal to the outer dimension of the members 24. FIG. 3 shows more clearly the extent of the outer dimension of cone 30 as being eqidistant with the outer surface 46 of the members 24 which define the cage 20. It could be shorter if desired.

Once cone 40 is installed over mandrel 18, ring 28 is threaded through lower end 26 and the assembly is complete as shown as FIG. 3.

Figure 8C:
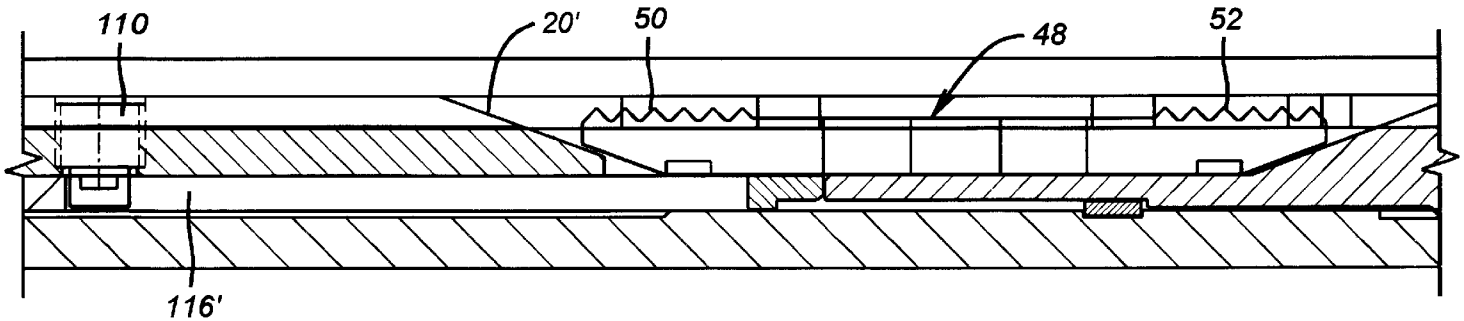
Figure 8D:
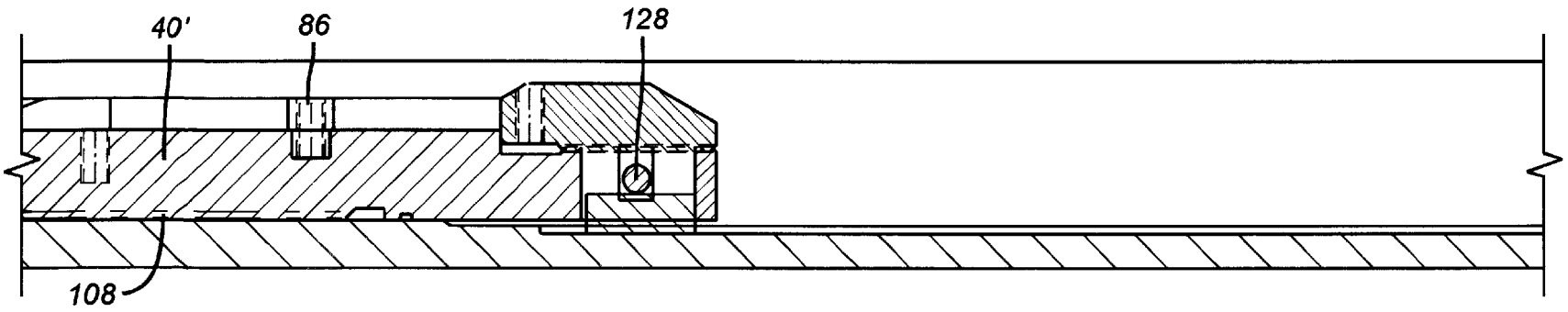
Figure 10A:
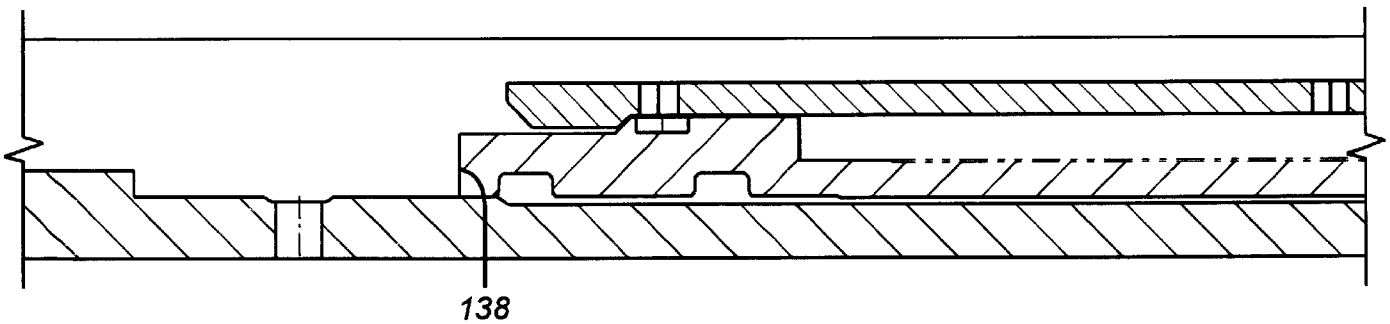
FIGS. 10*a–d* illustrate the fully released position after the lower cone has been moved downwardly from the lower slips and the mandrel picked up from the surface.
Figure 10B:
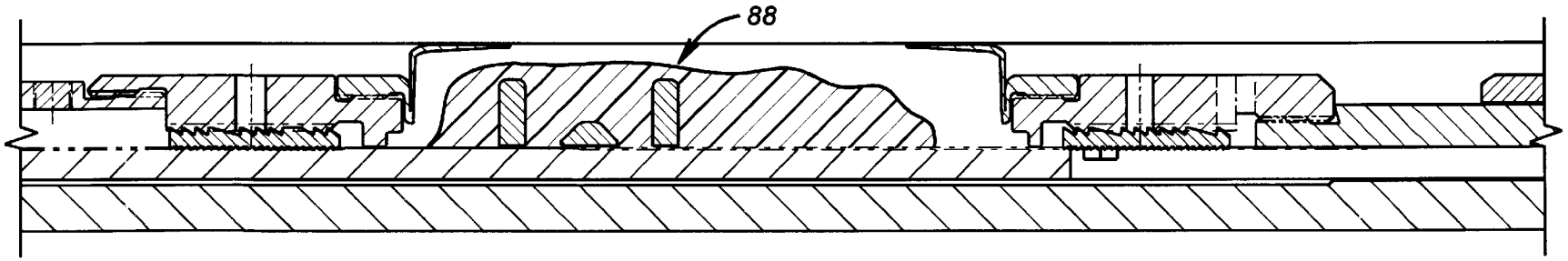
Figure 12:
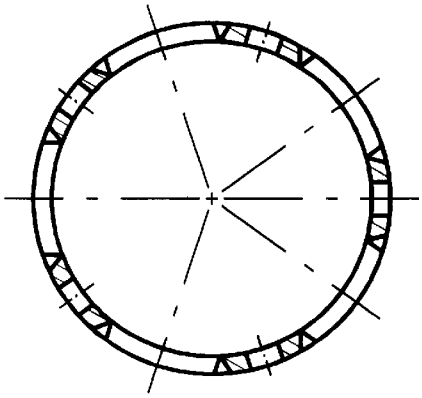
FIG. 12 is an end view of the cage shown in FIG. 11.
Figure 13:
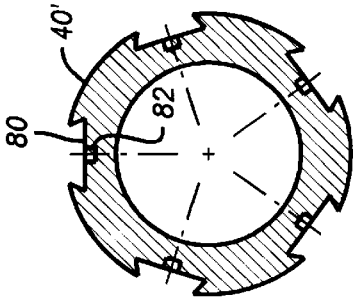
FIG. 13 is an end view of the lower cone, indicating the dove-tailed passages which accept the lowermost portions of the cage shown in FIG. 11.
Figure 11:
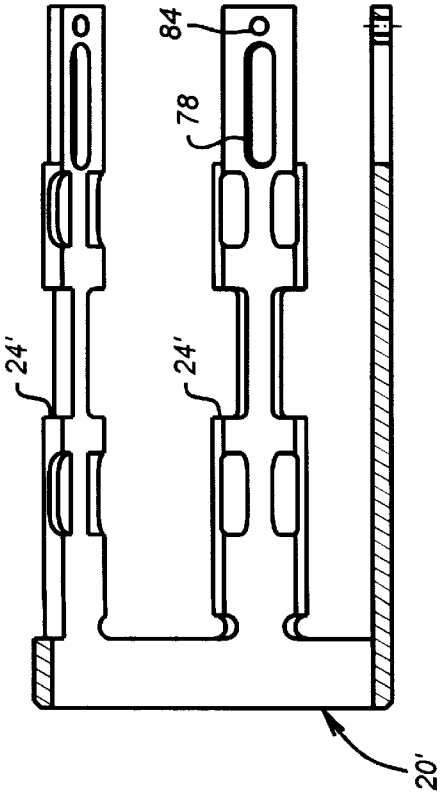
FIG. 11 is a side view of the preferred embodiment of the cage, indicating the lower end slots which capture the lower cone.

FIG. 11 illustrates the preferred embodiment for the cage 20'. Each of the longitudinal members 24' has a slot 78. Referring to the end view of FIG. 12, it can be seen that the longitudinal members 24' have a trapezoidal cross-section designed to be slidably inserted into a conforming slot 80 in the cone 40'. A pin (not shown) extends into threaded opening 82 after extending through the slot 78. Accordingly, the length of slot 78 defines a range of relative movement between the cage 20' and the cone 40'. Each of the longitudinal members 24' has a hole 84 to accept a shear screw 86 (see FIG. 8*d* to control the sequence of setting the sealing element assembly 88 after setting the slips 48. Upon release of the slips 48 as will be described below for the preferred embodiment, the pin in opening 82 catches in the slot 78 to retain the lower cone 40' to the cage 20'. This design of the preferred embodiment of the cage 20' eliminates the use of the ring 28 which can be difficult to mount over slender longitudinal members 24 and which may require the elimination of some material to accommodate a thread which would accept the ring 28. Instead, the longitudinal members 24' are guided in a dove-tail type arrangement for relative longitudinal movement as between the lower cone 40' and the cage 20'. In all other respects, the function of the components, including the lower cone 40' and the cage 20', is similar to the embodiment illustrated in FIGS. 2 and 3.

As part of the assembly after installation of cone 30, the slips 48 (there being four shown in FIG. 2) are installed into the cage 20 prior to insertion of the mandrel 18. In the preferred embodiment, the slips 48 are all identical and, therefore, only one will be described with the understanding that the description is equally applicable to the remaining slips. However, it should be noted that it is within the purview of the invention to use slips of differing design and that only the preferred embodiment is intended to include identical slips laid out at 90° spacing about the longitudinal axis of the tool with opposed wickers. The slip 48 has opposed wickers 50 and 52 extending from opposed T-shaped bodies 54 and 56, respectively. A recess 58 is located on each side of each of the members 24 such that the extending tab sections 60 and 62 extend into recess 58 symmetrically on both sides of bodies 54 and 56. The recesses 58 clearly do not retain the bodies 54 and 56 against outward movement. Instead, the function of recesses 58 is in the retrieval of the downhole tool for effecting release of the slips 20. In essence, tabbed section 62 defines a pickup shoulder 64 which is engaged by a shoulder 66 (formed as part of recess 58) for release of the slips 20, as will be described below.

Referring again to FIG. 2, the members 24 each have an undercut 68 extending from opposed edges thereof. "Undercut" is a term meant to include open slots as shown or closed slots such as a grove disposed completely in the middle of the edge of members 24. This undercut engages a pair of opposed tabs 70 and this is the mechanism which limits the radial outward travel of the slips 48 as the tabs 70 come into contact with the end of the undercut 68. The assembled view of FIG. 3 does not show the tabs 70 and undercut 68 but they can be more readily seen in FIG. 2.

Thus, after cone 30 is inserted through the open end of cage 20 and all the slips 48 are inserted such that their tabs 70 are in undercut 68 and tabbed section 60 and 62 are within recess 58, the mandrel 18 is pushed through the cone 30 as the cone 40 is installed over the mandrel and the entire assembly is secured by ring 28.

Figure 4:
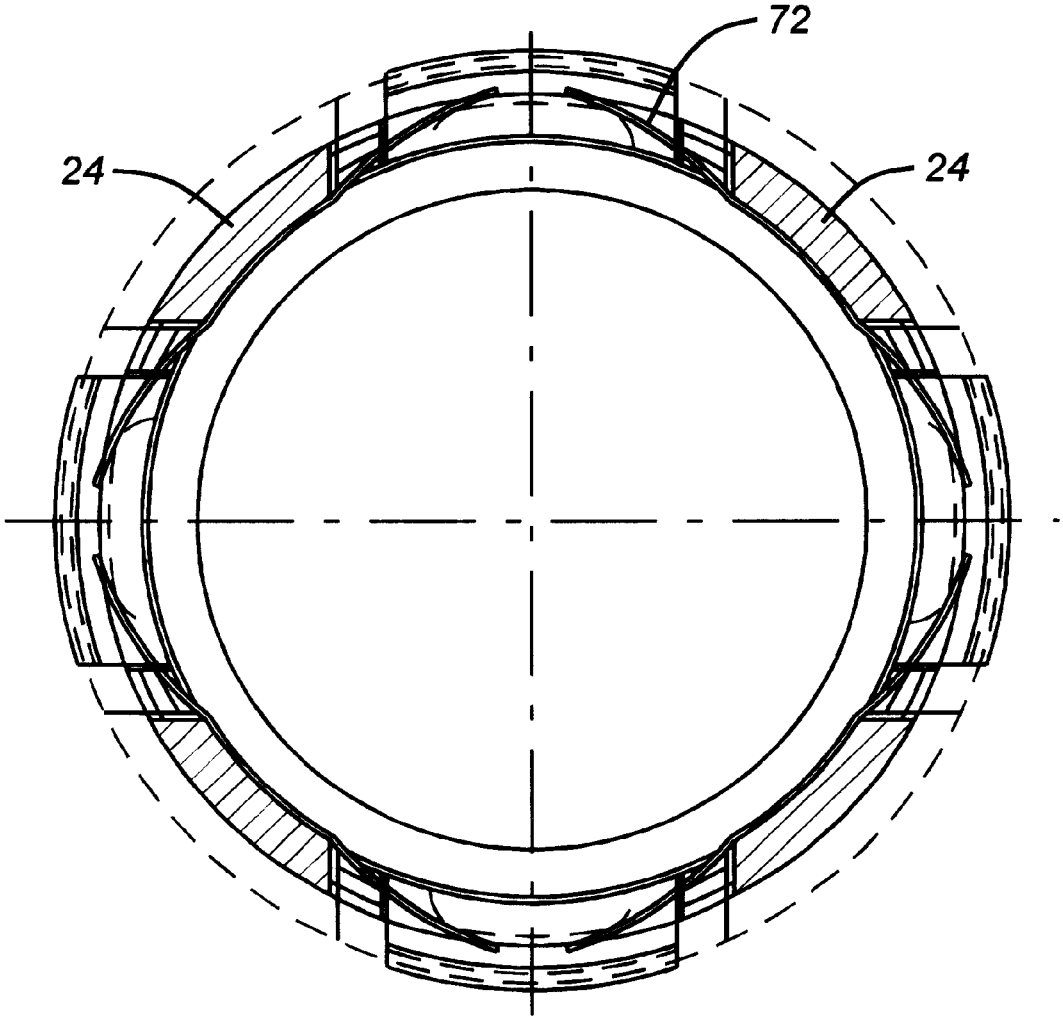
FIG. 4 is a section along lines 4—4 of FIG. 3.

The slips 48 are biased radially inwardly by band springs 72 which are more clearly shown in FIG. 4. It should be noted that the band springs have been deliberately omitted from FIGS. 2 and 3 for clarity of the drawings but are shown in the section view of FIG. 4. The band springs 72 span over a slip 48 generally in the area of recess 74 shown in FIG. 3. The springs 72 extend below the members 24 through apertures 76 which even at full extension of the slips 48 still leaves clearance so that the spring 72 is not cut as the slips 48 are forced out by the cones 30 and 40.

The operation of the caged slip assembly as depicted in FIGS. 2 and 3 is also shown in section in FIGS. 5 and 7. FIG. 5 is the run-in position which shows the slips 48 in a retracted position so that the wickers 50 do not extend beyond the outer dimension 46 of the cage 20. FIG. 6*b* illustrates the slips 48 in the extended position which is also shown in the perspective view of FIG. 3. Both cones move with respect to the slips. In order to accomplish this, in the known manner, by differential movement, the cone 40 is held stationary while the cone 30 is advanced toward it. This results in ramp 36 pushing out the slips 48 against tapers 42 of cone 40. As a result, the slips 48 move radially outwardly until they engage the casing (not shown) or until the tabs 70 engage their travel limits within undercut 68. The released position is shown in FIG. 7(b). This is accomplished by an upward force directed to cone 30 which forces shoulder 32 against member 34. The upward force applied to cone 30 pulls the tapered surface 36 out from under the slips 48 plus engages shoulder 32 to the cage 20 to impart an upward force on the cage 20. This in turn is transmitted to the slip assembly by virtue of shoulder 66 contacting pickup shoulder 64, which in turn pulls the slips 48 away from tapered surfaces 42 of cone 40.

When setting the packer P as shown in FIGS. 5 and 6, relative movement occurs between a bottom sub 90 and a lock ring 92 which contains locking teeth 94. Setting of the packer P as shown in FIG. 6*c* involves downward movement of lock ring 92 relative to sub 90, with teeth 94 holding the set. Release is accomplished by a pickup force on the mandrel 96. Mandrel 96 has a ring 98 which engages release ring 100 and carries it to shoulder 102. The connection between the mating teeth 94 is now liberated as the release ring 100 moves away from teeth 94 to allow lock ring 92 to move past teeth 94 on the sub 90. The packer P can then be extended for removal from the wellbore. During release, the sequence is such that the upper cone 30 is pulled away from the upper end of the slips 48, as shown in FIG. 7*b*. As previously described, the cage 20 is left to pull the teeth or wickers 52 out of the casing with cone 40 still wedging against slip 48. This type of release can be problematic in the sense that the wickers 52 have already dug into the casing and pulling them off of a cone such as 40 may at times be difficult to accomplish. Thus, in a preferred embodiment of the present invention illustrated in FIGS. 8–10, the lower cone 40' is actually mechanically driven out from under the lower wickers 52 prior to cage 20' interacting with the slips 48 in an attempt to pull wickers 52 relative to the casing. This will be explained in more detail below.

Figure 1:
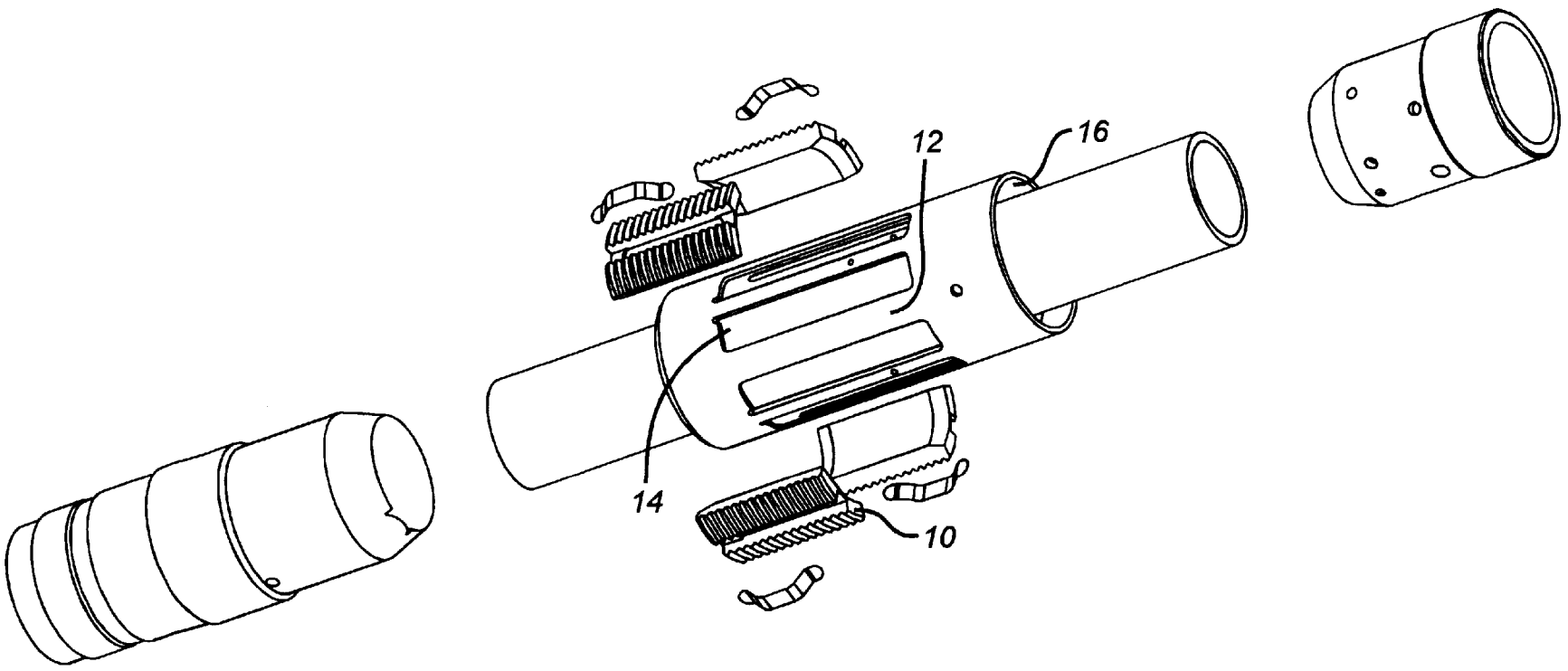
(PRIOR ART) FIG. 1
FIG. 1 is a perspective view of a prior art caged slip showing limitations of bearing load transmitted to the slips from the cones, as well as limitations of outer extension created by the design.

Those skilled in the art will appreciate the advantageous features of the disclosed design. The cones 30 and 40 have tapers 36 and 42 which extend to outer dimensions such as 38 which are at least equal to the outer dimension 46 of the cage 20. What this means is that the ramp surfaces 36 and 42 can bear over a greater area on the slips 48 and the amount of bearing area is not limited as in the prior art where the cone assembly in its entirety, including the ramp surfaces, was behind the openings 14 of the longitudinal members 12 which define the cage as shown in the prior art FIG. 1. Additionally, the use of the tabs 70 regulates the radial outward movement of the slips 48 in case they are extended to their maximum limit without encountering a segment of the casing.

With the design shown in FIGS. 2 and 3, the thickness of members 24 can vary to allow the appropriate structural strength to the cage assembly 20. However, varying the thickness of members 24 does not limit the outer travel available to the slips 48. The definition of the outer travel of the slips 48 is given by the depth and/or location of the undercut 68 and the position of the tabs 70 on the slips 48 in relation with the wickers 50. Since the members 24 already have larger recesses such as 58 to accommodate the slips 48, the undercut 68 can be varied so that a relatively thick cross-section of the members 24 can be employed while in discrete small areas an undercut 68 can be provided to allow significant radial movement of the slips 48. This versatility allows a single tool to be used in situations involving casings of different wall thicknesses as opposed to having on tap a variety of tools to be used depending on the particular casing size in which the slips 48 are to be set. Finally, the full advantages of protecting the slips 48 used in a caged design is retained while these other additional advantages are obtained. To further protect the slips 48 during run-in, the springs 72 hold them in a retracted position between the members 24. Thus, with the cones in effect being disposed in the windows defined between members 24, a greater load capacity of the slips 48 is achieved as the compact area on the slips 48 is increased. The cage 20 also serves as a transmission conduit for a pickup force which pulls the slips 48 off of tapers 42 on cone 40.

Referring to FIGS. 9*a–d*, the setting and releasing technique of the preferred embodiment will be described. The mandrel 96' extends through the packer P. A setting sleeve 104 is used to push against upper gauge ring 106, which in turn compresses the element assembly 88 against the lower cone 40' which is held by the mandrel 96' at threads 108. The lower cone 40' supports the body 18'. The upper cone 30' is retained to the body 18' by lock pin 110. Accordingly, downward pressure on the setting sleeve 104 with a known setting tool breaks shear pin 86, allowing wickers 52 to be ramped outwardly on lower cone 40'. Thereafter, lock pin 110 moves down with cone 30' in a slot 116 in body 18', allowing upper cone 30' to move wickers 50 outwardly against the casing. Thereafter, the sealing element system 88 is compressed and the set position of the slips 48 is held by body lock ring 112, while the set of the seal element system 88 is held by body lock ring 114. The fully set position is shown in FIG. 9. Here, the lock pin 110 has translated in slot 116 of body 18', allowing the upper cone 30' to be forced under wickers 50, whereupon lock ring 112 holds the set of the slips 48. The sealing element system 88 has been compressed against the casing and its position secured by lock ring 114.

Figure 9A:
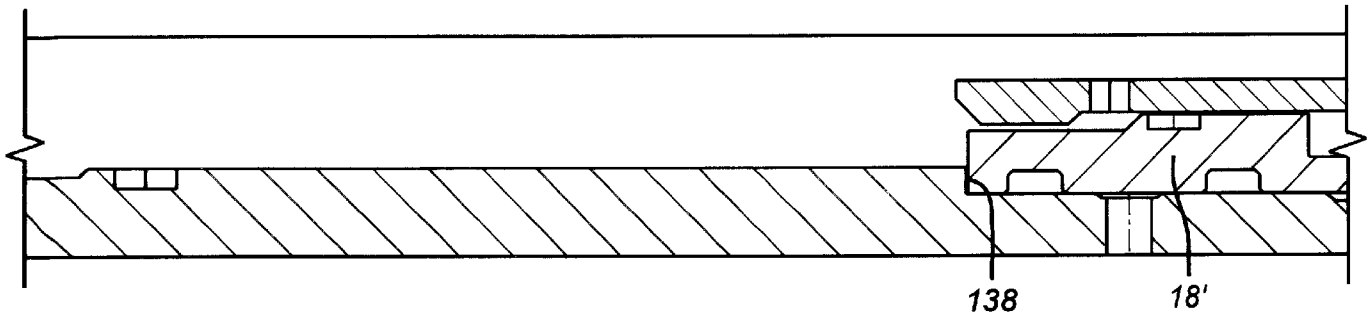
FIGS. 9*a–d* are the views of FIGS. 8*a–d,* showing the packer in the set position.
Figure 9B:
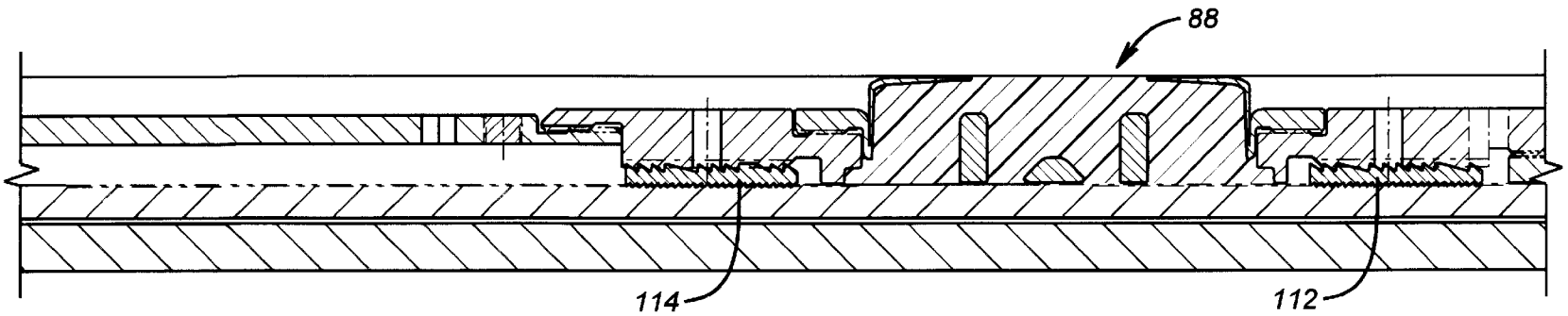
Figure 9C:
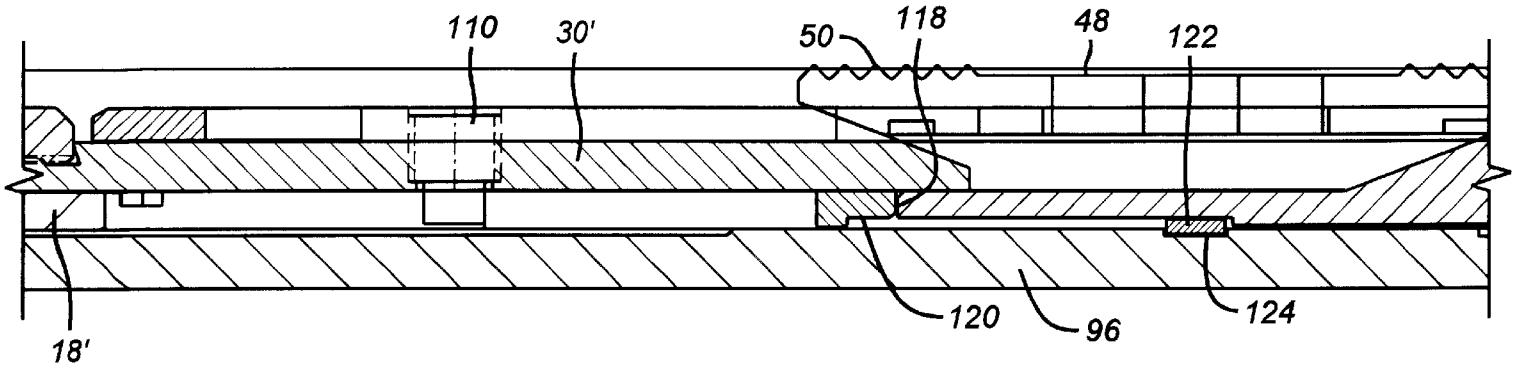
Figure 10C:
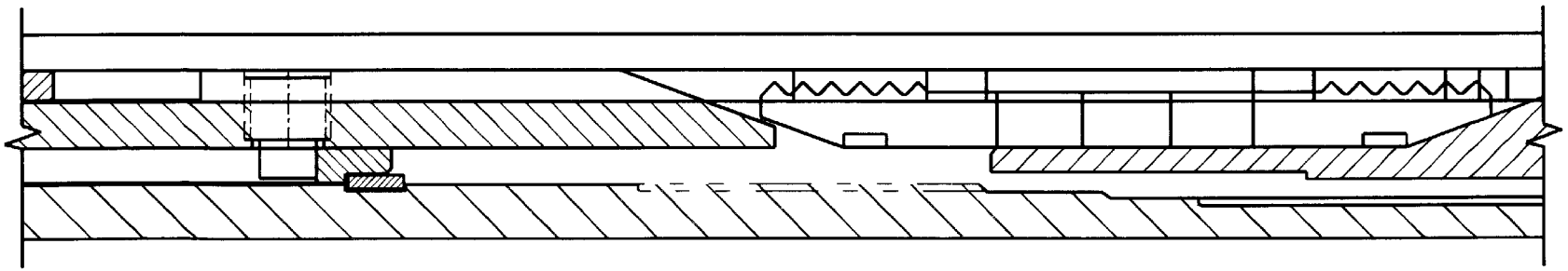
Figure 9D:
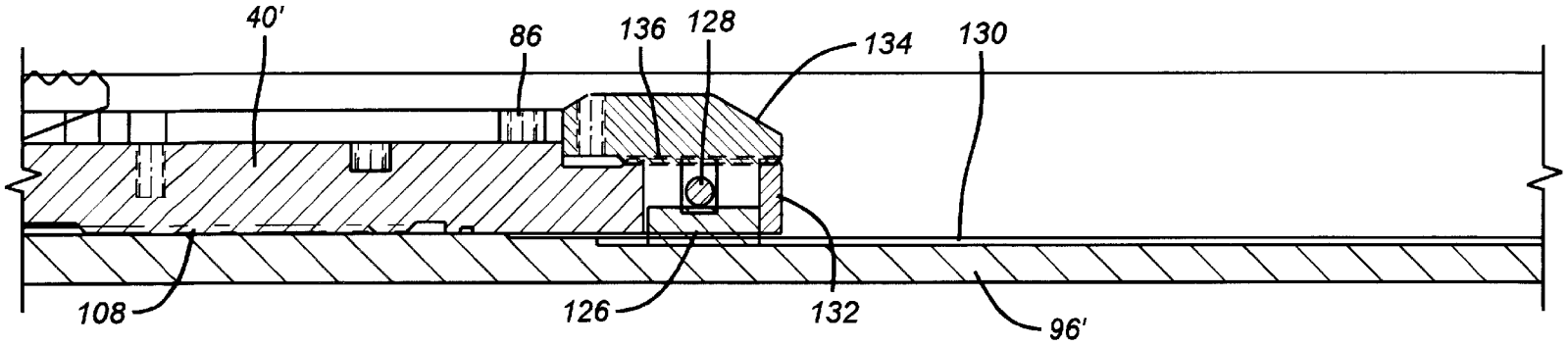
Figure 10D:
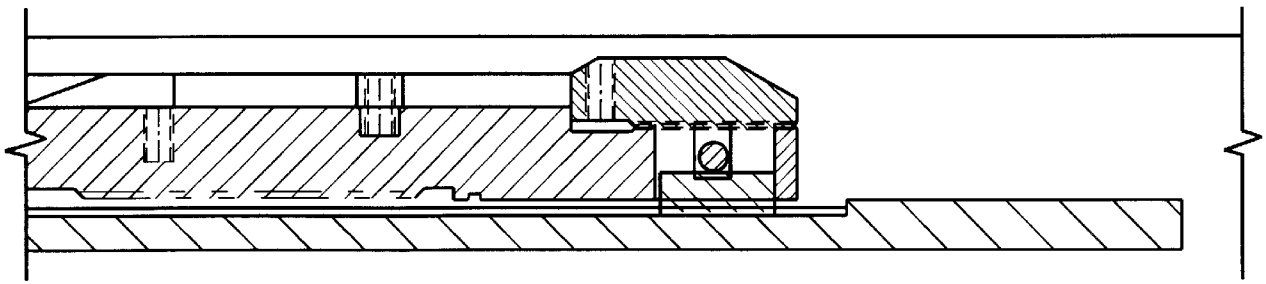

Referring to FIGS. 9*c* and *d*, the body 18' has a lower end 118 with an internal pickup shoulder 120. A split ring 122 sits in groove 124 on the mandrel 96'. At the lower end of the lower cone 40' is a wedge member 126 biased with a garter spring 128 against an elongated groove 130 on the mandrel 96'. The wedge 126 is held to the lower cone 40' by a ring 132 which is secured from drift ring 134, which is itself connected to lower cage 20' at thread 136.

Release of the packer P involves rotating mandrel 96' to the right under a setdown force. The mandrel 96' bears against body 18' at a shoulder 138 (see FIG. 9*a*). The thread 108 is left-hand so that rotating the mandrel 96 to the right, with mandrel 96' bearing down on body 18', forces the lower cone 40' to rotate in the opposite direction and thus translate downhole away from wickers 52. The pin (not shown) in groove 78 defines the lower range of movement of lower cone 40'. The bias of garter spring 128 on wedge 126 further facilitates the relative rotation and, thus, translation of the lower cone 40 with respect to the mandrel 96'. After a sufficient amount of rotation to the right which would have driven the lower cone 40 downwardly, a pickup force is applied to the mandrel 96' and the body 18' is engaged by mandrel 96' as split ring 122 engages shoulder 120. A pickup force thereafter results in pulling out the upper cone 30', and with it cage 20', from under wickers 50 in the manner previously described. However, due to the initial forcible movement of lower cone 40' downwardly, the cage 20' can pull the slips 48 back to a relaxed position shown in FIG. 10*c*, without having to pull the wickers 52 out of the casing since the downward extension of lower cone 40' has undermined the wickers 52 at the time that the upper cone 30' is pulled out from under wickers 50 and continues to pull the slip assembly 48 through cage 20' upwardly in a situation where wickers 52 are no longer wedged into the casing by lower cone 40'. The slips 48 settle into the position shown in FIG. 10*c,* while the sealing element system 88 fully relaxes so that the packer P can be pulled out.

Situations could arise where it is not known at the surface if there is a downward force applied on mandrel 96 at thread 108. If there is a residual tensile force while mandrel 96' is turned to the right, mandrel 96' will simply unthread at thread 108 and rise upwardly. The packer P can still be released in the manner just described if, after sufficient turning to the right to release thread 108, weight is again set down. This setdown weight after undoing thread 108 will put a downward load on lower cone 40' through the undone threads 108 to force it down and away from under wickers 52. Thereafter, an upward force can be applied to mandrel 96 and the release procedure from that point is identical.

Those skilled in the art can see that one of the unique features of the packer P of the present invention is that the slips are not pulled off of the cones, which is generally a difficult way to release. Instead, whether the mandrel 96 is in compression or tension, a technique is illustrated to mechanically force the lower cone 40' out from under wickers 52 of slips 48 a sufficient distance so that when an upward force is applied, the upper cone 30' can be pulled out from under wickers 50, which can then be followed by upward movement of the slips 48 where wickers 52 are already undermined due to previous downward forcing of lower cone 40'. The contrast in the release of the packer P between the preferred embodiment illustrated in FIGS. 8–10 can be more clearly seen by a comparison to the technique revealed in FIGS. 5–7. The significant difference in the two embodiments is that the lower cone 40' is forcibly moved out from below the lower slip or lower wickers 52. The technique shown in FIGS. 8–10 can be used for any kind of slip system and is not limited to the cage and slip design revealed in FIGS. 2 and 3. It can be used for slip systems oriented in one direction or combination slip systems oriented in opposed directions without departing from the spirit of the invention, and can be used with a variety of slip-retaining systems. Rather than using a thread such as 108, other techniques to mechanically displace the lower cone 40 can be employed, such as a J-slot system. One of the features of the present invention is that it is simple to build and operate and, therefore, more reliable, particularly when compared to prior systems involving a multitude of pistons which are actuated hydraulically by dropping balls so as to cause setting and release hydraulically of a sealing system and slip system, such as previously used in dual-bore packers by Baker Oil Tools and offered under Model CT-ESP.

The foregoing disclosure and description of the invention are illustrative and explanatory thereof, and various changes in the size, shape and materials, as well as in the details of the illustrated construction, may be made without departing from the spirit of the invention.

What is claimed is:

1. A slip system for securing and releasing a tool from the surface to a tubular downhole comprising:

a mandrel;

at least one uphole slip and at least one downhole slip, said downhole slip located further from the surface than said uphole slip, said uphole and downhole slips being discrete or unitary;

an upper setting mechanism and a lower setting mechanism on said mandrel to selectively respectively force said uphole and downhole slip away from said mandrel for contact with the tubular; and said mandrel operatively connected to said lower setting mechanism to force it away from said downhole slip prior to said upper setting mechanism moving away from said uphole slip for release of said mandrel from the tubular.

2. The slip system of claim 1, further comprising:

a connection between said mandrel and said lower setting mechanism which converts rotation of said mandrel to translation of said lower setting mechanism away from said downhole slip.

3. The slip system of claim 1, wherein:

said upper and lower setting mechanisms comprise an upper and lower cone.

4. The slip system of claim 3, wherein:

said lower cone is rotationally locked but free to translate;

said mandrel is operatively connected to said lower cone by a thread so that rotation of said mandrel translates said lower cone away from said downhole slip.

5. The slip system of claim 1, wherein:

said upper and lower setting mechanisms comprise an upper and a lower cone;

said cones are retained to said mandrel by a cage which comprises a plurality of openings;

said cones further comprise a plurality of tapered surfaces that extend into said openings.

6. The slip system of claim 5, wherein:

said cage has an outer surface and a longitudinal axis;

said openings are substantially aligned with said longitudinal axis; and said tapered surfaces of said cones extend into said openings up to said outer surface of said cage.

7. The slip system of claim 6, wherein:

said cage comprises a plurality of spaced longitudinal members to define said openings;

said slips further comprise tabs which engage said longitudinal members to provide a travel stop for said slips in the direction away from the longitudinal axis of said cage.

8. The slip system of claim 7, wherein:

said tabs are located on opposed edges of said slips and said spaced longitudinal members have undercuts on opposed sides of each opening and not extending to said outer surface of said cage to stop travel of said slips.

9. The slip system of claim 8, wherein:

said cage comprises a base ring from which said longitudinal members extend;

said lower cone comprises slots to accept and retain said longitudinal members in a slidable relation.

10. The slip system of claim 9, wherein:

said slots conform to the cross-sectional shape of said longitudinal members to retain said members in their respective slots;

said members comprising a longitudinal slot which accepts a pin in said lower cone for retention together while allowing a range of longitudinal relative movement.

11. A slip system for selectively securing and releasing a tool to a tubular downhole, comprising:

a mandrel;

at least one slip;

a cage mounted over said mandrel having at least one opening, said slip movable in said opening for selective contact with the tubular; and at least one cone movably mounted to said mandrel by said cage, said cone comprising at least one camming surface extending into said opening.

12. The slip system of claim 11 wherein:

said cage has an outer surface and a longitudinal axis; and said camming surface comprises a tapered surface extending away from said longitudinal axis at most, as far as said outer surface of said cage.

13. The slip system of claim 12 wherein:

said cage is formed by a plurality of extending members from a base ring, said extending members having spaces therebetween which comprise a plurality of said openings; and said at least one slip comprises a plurality of slips whose movement in a direction away from the longitudinal axis of said cage is limited by said extending members.

14. The slip system of claim 13, wherein:

said extending members comprise undercuts not extending to said outer surface of said cage, said slips further comprise edge tabs to engage said undercuts to limit outward travel away from said longitudinal axis.

15. The slip system of claim 13, wherein:

said extending members comprise a notch and said slips comprise a tab which is disposed in said notch to prevent relative longitudinal movement between said cage and said slips.

16. The slip system of claim 15, wherein:

said at least one cone comprises an upper and lower cone having corresponding upper and lower tapered surfaces, said tapered surfaces disposed in a mirror image with respect to each other; and said upper tapered surfaces form a shoulder which can engage said base ring such that a force applied to said upper cone is transmitted to said notch so that said slips are pulled away from said lower cone as said upper cone is pulled away from said slips.

17. The slip system of claim 12, wherein:

said slip having an uphole and a downhole component and a construction which is unitary or in pieces;

said at least one cone comprises an upper and a lower cone with tapered surfaces respectively on said upper cone disposed in a mirror image with respect to said tapered surfaces on said lower cone with said slip in between said tapered surfaces; and said mandrel operatively connected to said lower cone to move it away from under said downhole component of said slip, said lower cone moving away from said downhole component of said slip before an upward force to said cone pulls it away from said uphole component of said slip.

18. The slip system of claim 17, wherein:

said lower cone is threadedly engaged to said mandrel and is rotationally locked to said cage so that rotation of said mandrel translates said lower cone away from said downhole component of said slip.

19. The slip system of claim 18, wherein:

said lower cone comprises slots shaped to accept and be retained by said cage; and said cage comprising a base ring and extending members which are slidably engaged to said slots in said lower cone.

20. The slip system of claim 13 wherein:

said at least one cone comprising an upper and a lower cone;

said tapered surfaces are disposed respectively on said upper and lower cones and in mirror image as between said upper and lower cones and each said tapered surface defines a shoulder extending into said opening;

said cage further comprises a closure ring to connect ends of said extending members thus defining said openings and retaining said cones to said cage by virtue of said shoulders engaging said base or closure ring.

21. A slip system for supporting a tool downhole, comprising:

a tool body;

a slip cage mounted to said tool body defining at least one opening and having a predetermined outside diameter;

at least one slip movably mounted in said opening;

at least one cone, said cone having a sloping surface to engage said slip, said sloping surface of said cone extending into said opening.

22. The system of claim 21, wherein:

said slip cage comprises a longitudinal axis and said opening is defined between a plurality of longitudinally extending members;

said slip further comprises at least one first tab which defines an outward travel limit of said slip when it contacts one of said longitudinally extending members.

23. The system of claim 22, wherein:

said longitudinally extending members comprise an undercut adjacent said opening, said first tab on said slip disposed in said undercut.

24. The system of claim 23, wherein:

said longitudinally extending members comprise a recess;

said slip comprises at least one second tab extending into said recess to facilitate longitudinal movement of said slip by said cage relative to said cone.

25. The system of claim 24, further comprising:

a biasing member acting on said slip to urge it inwardly toward said longitudinal axis.

26. The system of claim 21, wherein:

said sloping surface extends outwardly into said opening to a dimension as great as said predetermined outside diameter of said slip cage.

27. The system of claim 26, wherein:

said sloping surface extends outwardly into said opening as far as said outside diameter of said slip cage.

28. The system of claim 26, wherein:

said at least one opening further comprises a plurality of openings defined by longitudinally extending members;

said at least one slip and said at least one cone further comprise a plurality of slips with at least one slip in each said opening and at least one cone having a sloping surface in each said opening to engage said slip;

said sloping surfaces separated circumferentially from each other so that they straddle said longitudinally extending members while extending into said openings.

29. The system of claim 28, wherein:

said at least one cone comprising an upper and a lower cone mounted on either end of said slip, such that the respective sloping surfaces of said cones can selectively contact said slips for outward movement through said openings.

30. The system of claim 29, wherein:

said slip further comprises at least one first tab which defines an outward travel limit of said slip when it contacts one of said longitudinally extending members.

31. The system of claim 30, wherein:

said longitudinally extending members comprise undercuts such that each opening has two opposed undercuts;

said at least one first tab comprises a pair of first tabs on said slips disposed in said undercut to limit outward movement of said slips through said openings.

32. The system of claim 31, wherein:

said longitudinally extending members having a thickness which does not limit outer travel of said slips, said outer travel limit defined by engagement of said first tabs in said undercuts.

33. The system of claim 32 wherein:

said longitudinally extending members comprise recesses such that each opening has two opposed recesses;

said slips further comprise opposed second tabs extending into said recesses;

said cage engageable to said slips through said recesses engaging said second tabs to longitudinally shift said slips away from said lower cone.

34. The system of claim 33, wherein:

said upper cone comprising a shoulder adjacent its sloping surfaces which is engageable to said slip cage, whereupon translation of said upper cone, in tandem with said slip cage, pulls said slips away from said lower cone.

35. The system of claim 34, wherein:

a biasing member acting on each slip to bias said slips internally into said openings.

36. The system of claim 35, further comprising:

wickers in opposed orientations on said slips.

37. The system of claim 23, wherein:

said undercut is sufficiently deep so as to allow said slip sufficient outward travel range through said opening such that all wall thicknesses of a given size tubular can be engaged by said slips mounted in said tool body.

* * * * *